US010952005B1

(12) United States Patent
McGrael et al.

(10) Patent No.: US 10,952,005 B1
(45) Date of Patent: Mar. 16, 2021

(54) STEREO PAIRED SPEAKER SYSTEM WITH CENTER EXTRACTION

(71) Applicant: Bose Corporation, Framingham, MA (US)

(72) Inventors: John Lawrence McGrael, Cambridge, MA (US); Benjamin Jackson Clark, Hopkinton, MA (US); David Lester Smith, Wellesley, MA (US); Michael Wayne Stark, Acton, MA (US); James Walter Tracey, Norfolk, MA (US); Nabin Sagar Sharma, Shrewsbury, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/654,142

(22) Filed: Oct. 16, 2019

(51) Int. Cl.

| | |
|---|---|
| ***H04S 7/00*** | (2006.01) |
| ***H04R 5/02*** | (2006.01) |
| ***H04R 5/04*** | (2006.01) |
| ***H04S 1/00*** | (2006.01) |

(52) U.S. Cl.
CPC ..... *H04S 7/30* (2013.01); *H04R 5/02* (2013.01); *H04R 5/04* (2013.01); *H04S 1/007* (2013.01); *H04S 2400/05* (2013.01)

(58) Field of Classification Search
CPC ..... H04R 2227/05; H04R 5/04; H04S 7/30; H04S 1/007
See application file for complete search history.

(56) References Cited

U.S. PATENT DOCUMENTS

| | | | | |
|---|---|---|---|---|
| 5,809,153 | A * | 9/1998 | Aylward | H04R 1/20 381/160 |
| 9,942,513 | B1 * | 4/2018 | Aarrestad | H04N 7/142 |
| 10,433,092 | B2 * | 10/2019 | Chamness | H04R 3/12 |
| 2013/0331970 | A1 * | 12/2013 | Beckhardt | G06F 3/165 700/94 |

* cited by examiner

*Primary Examiner* — Regina N Holder
(74) *Attorney, Agent, or Firm* — Hoffman Warnick LLC

(57) ABSTRACT

Various implementations include speaker systems. In some particular cases, a speaker system includes: at least two distinct loudspeakers each capable of outputting stereo audio on its own, wherein each loudspeaker comprises: a plurality of transducers, and a controller coupled with the plurality of transducers, where the controller in each loudspeaker is configured to: receive a left channel audio input signal and a right channel audio input signal; extract a center channel signal from the left channel audio input signal and the right channel audio input signal; and provide an audio output signal to at least one of the plurality of transducers for outputting the center channel signal.

16 Claims, 6 Drawing Sheets

STEREO PAIRED SPEAKER SYSTEM WITH CENTER EXTRACTION

TECHNICAL FIELD

This disclosure generally relates to loudspeakers. More particularly, the disclosure relates to a system and related controllers for controlling stereo pairing of speakers.

BACKGROUND

Stereo paired speakers are distinct speaker units that are paired into a singular playback system for stereo signals containing both left and right channels. In a conventional stereo pair, one of the speaker units is designated as left (playing left-channel content) and the other is designated as right (playing right-channel content). However, for speaker units with multiple transducers, the orientation of those transducers in stereo pairs can create opposing firing patterns that diminish performance.

SUMMARY

All examples and features mentioned below can be combined in any technically possible way.

Various implementations include systems for controlling stereo pairing of loudspeakers. In additional implementations, a method of controlling stereo pairing of loudspeakers is disclosed. In other implementations, a loudspeaker configured to pair with one or more additional loudspeakers is disclosed.

In some particular aspects, a speaker system includes: at least two distinct loudspeakers each capable of outputting stereo audio on its own, where each loudspeaker includes: a plurality of transducers, and a controller coupled with the plurality of transducers, where the controller in each loudspeaker is configured to: receive a left channel audio input signal and a right channel audio input signal; extract a center channel signal from the left channel audio input signal and the right channel audio input signal; and provide an audio output signal to at least one of the plurality of transducers for outputting the center channel signal.

In another aspect, a loudspeaker includes: a plurality of transducers; and a controller coupled with the plurality of transducers, where the loudspeaker is configured to both output stereo audio on its own in a first mode, and pair with an additional loudspeaker in a second mode, where in the second mode, the controller is configured to: receive a left channel audio input signal and a right channel audio input signal; extract a center channel signal from the left channel audio input signal and the right channel audio input signal; and provide an audio output signal to at least one of the plurality of transducers for outputting the center channel signal.

In an additional aspect, a method of controlling audio output from at least two distinct loudspeakers each having a plurality of transducers is disclosed. The method includes: at each of the loudspeakers: receive a left channel audio input signal and a right channel audio input signal; extract a center channel signal from the left channel audio input signal and the right channel audio input signal; and provide an audio output signal to the plurality of transducers for outputting the center channel signal.

In a further aspect, a speaker system includes: at least two distinct loudspeakers each capable of outputting stereo audio on its own, where each loudspeaker includes: a plurality of transducers, and a controller coupled with the plurality of transducers, and where one of loudspeakers includes a master speaker, where the controller in the master loudspeaker is configured to: receive a left channel audio input signal and a right channel audio input signal; extract a center channel signal from the left channel audio input signal and the right channel audio input signal; and provide audio output signals to one of the transducers at each of the at least two distinct loudspeakers for outputting the center channel signal.

In another aspect, a speaker system includes: at least two distinct loudspeakers each capable of outputting stereo audio on its own, where each loudspeaker includes a plurality of transducers; and a controller coupled with the at least two distinct loudspeakers, where the controller is configured to: receive a left channel audio input signal and a right channel audio input signal; extract a center channel signal from the left channel audio input signal and the right channel audio input signal; and provide audio output signals to one of the transducers at each of the at least two distinct loudspeakers for outputting the center channel signal.

Implementations may include one of the following features, or any combination thereof.

In some cases, the center channel signal includes correlated content from the left channel audio input signal and the right channel audio input signal.

In particular aspects, the center channel signal of one of the at least two distinct loudspeakers is different from the center channel signal of another of the at least two distinct loudspeakers.

In certain implementations, the center channel signal of the one of the at least two distinct loudspeakers includes a greater percentage of the left channel audio input signal relative to the center channel signal of the other of the at least two distinct loudspeakers.

In some aspects, one of the at least two distinct loudspeakers is configured to output, via at least one of its plurality of transducers, right channel audio based on the right channel audio input signal, and another of the at least two distinct loudspeakers is configured to output, via at least one of its plurality of transducers, left channel audio based on the left channel audio input signal.

In particular cases, the left channel audio and the right channel audio are each modified relative to the left channel audio input signal and right channel audio input signal, respectively.

In certain implementations, at least one of the plurality of transducers at each loudspeaker outputs the center channel signal.

In particular cases, only one of the plurality of transducers at each loudspeaker outputs the center channel signal.

In some aspects, the at least two distinct loudspeakers are paired to comprise a singular playback system.

In particular implementations, the at least two distinct loudspeakers include two loudspeakers, and the system further includes an additional loudspeaker paired with the two loudspeakers, the additional loudspeaker having at least one transducer.

In certain cases, the plurality of transducers of each loudspeaker includes at least a first transducer and a second transducer, the first transducer configured to output audio in an opposite direction than the second transducer.

In some implementations, one of the at least two distinct loudspeakers is configured to control at least one of the following for all other loudspeakers of the at least two distinct loudspeakers: distribution of the left channel audio input signal and the right channel audio input signal; playback operations; clock synchronization; volume changes; loudspeaker pairing; image display or microphone availability.

In certain aspects, the controllers at distinct loudspeakers are configured to pair the at least two distinct loudspeakers by: initiating audio output at one of the plurality of transducers on a first one of the loudspeakers; detecting the audio output at a microphone array on a second one of the loudspeakers; and determining a distance and relative orientation between the at least two loudspeakers based on a travel time for the audio output from the first one of the loudspeakers to the second one of the loudspeakers and a detected directionality of the audio output received at the second one of the loudspeakers.

In particular cases, one of the plurality of transducers outputs the center channel signal and another one of the plurality of transducers provides one of left channel audio based on the left channel audio input signal or right channel audio based on the right channel audio input signal, where the other one of the left channel audio or the right channel audio is provided at a transducer at the additional loudspeaker, and where the left channel audio and the right channel audio are each modified relative to the left channel audio input signal and right channel audio input signal, respectively.

In certain implementations, in the second mode: the loudspeaker and the additional loudspeaker are paired to comprise a singular playback system, and the loudspeaker acts as a master loudspeaker and the additional loudspeaker acts as a worker loudspeaker.

In particular aspects, the center channel signal includes correlated content from the left channel audio input signal and the right channel audio input signal, and only one of the plurality of transducers outputs the center channel signal.

In certain cases, a first one of the loudspeakers outputs left channel audio based on the left channel audio input signal and not right channel audio based on the right channel audio input signal, and a second one of the loudspeakers outputs the right channel audio and not the left channel audio.

In some cases, the controller in each loudspeaker is configured to output the stereo audio to account for inter-channel delay between the loudspeakers.

In particular aspects, the controller is housed in a separate physical device from the at least two distinct loudspeakers.

In certain implementations, the stereo audio that each of the at least two distinct loudspeakers is capable of outputting on its own is unmodified (also referred to as, full) stereo audio.

In some cases, the controller includes a digital signal processor (DSP).

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
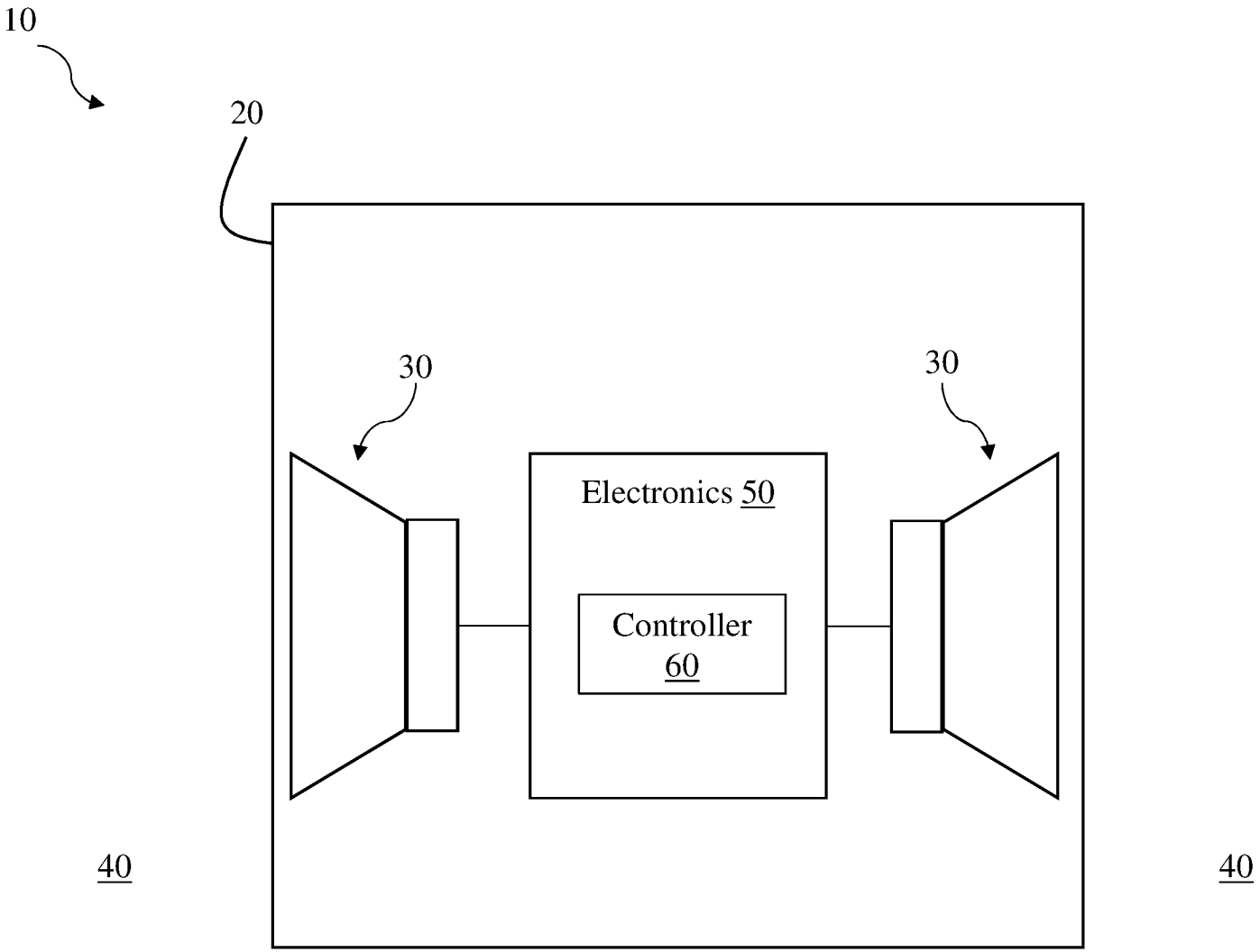
FIG. 1 is a schematic depiction of a loudspeaker according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a set of loudspeakers can be paired to provide a desired stereo output. For example, at least two loudspeakers capable of outputting stereo audio on their own can be paired and configured to output a center channel signal in order to enhance the user experience relative to the individual loudspeakers on their own.

Commonly labeled components in the FIGURES are considered to be substantially equivalent components for the purposes of illustration, and redundant discussion of those components is omitted for clarity.

As described herein, conventional stereo pairing of multi-transducer speakers can create opposing firing patterns that diminish performance. That is, for speaker units with multiple transducers, the orientation of those transducers in stereo pairs can create opposing firing patterns that diminish performance. For example, the user can perceive little or no separation between the left and right channel content, which negates the benefits of stereo pairing as compared with a single stereo-capable speaker.

In contrast to these conventional systems, the speaker systems disclosed according to various implementations include a controller that is configured to extract a center channel signal from a left channel audio input signal and a right channel audio input signal, and provide an audio output signal to one or more transducers at each speaker for outputting the center channel signal. In particular implementations, each loudspeaker has a controller for extracting the center channel signal and providing the audio output signal to the transducer(s). In other implementations, one of the loudspeakers has a controller for extracting the center channel signal and providing the audio output signal to the transducers at each of the loudspeakers in the system. In still further implementations, the controller is located in a device distinct from the loudspeakers which it controls.

FIG. 1 is a simplified schematic depiction of a loudspeaker (or simply, "speaker") 10. The speaker 10 has a housing 20 that at least partially contains a plurality of transducers 30 for outputting audio to the surrounding environment 40. In various implementations, the speaker 10 includes two transducers 30. In additional implementations (not shown), the speaker 10 includes three, four, five or more transducers. In some implementations, each of the transducers 30 is of the same design, e.g., in terms of frequency range (high-frequency or low-frequency), or output. In other implementations, one or more transducers 30 in the same speaker 10, or transducers in distinct speakers 10, can vary in design. That is, two transducers 30 in the same or different speakers 10 may not be of the same design, or type. Various electronics 50 are contained within the housing 20 of the speaker 10, including, for example, a controller 60. The controller 60 is coupled with the transducers 30, and is configured to control audio output at the transducers 30 based upon signal inputs from one or more local or remote sources (e.g., audio files stored at memory in the speaker 10, audio files or streams accessible via a communications module in the speaker 10 that is coupled with an external device such as an audio gateway or internet radio source). In certain cases, the controller 60 includes or is otherwise coupled with various additional components in the electronics 50, including a processor and/or microcontroller, which can include decoders, digital signal processor (DSP) hardware/software, etc. for playing back (rendering) audio content at one or both of the transducers 30. The electronics 50 (e.g., controller 60 or other component(s)) can also include one or more digital-to-analog (D/A) converters for converting the digital audio signal to an analog audio signal. This audio hardware can also include one or more amplifiers which provide amplified analog audio signals to the transducers 30. The electronics 50 can also include or be connected with one or more interfaces, e.g., conventional user interfaces such as buttons, touch screen(s), human-machine interfaces (HMIs), etc.

It is understood that one or more of the components in electronics 50 can be implemented as hardware and/or software, and that such components may be connected by any conventional means (e.g., hard-wired and/or wireless connection). It is further understood that any component described as connected or coupled to another component in the speaker(s) 10 or other systems disclosed according to implementations can communicate using any conventional hard-wired connection and/or additional communications protocols (e.g., a Wi-Fi protocol using a wireless local area network (LAN), a communication protocol such as IEEE 802.11 b/g, a cellular network-based protocol or one of a plurality of internet-of-things (IoT) protocols, such as: Bluetooth, BLE Bluetooth, ZigBee (mesh LAN), Z-wave (sub-GHz mesh network), 6LoWPAN (a lightweight IP protocol), LTE protocols, RFID, ultrasonic audio protocols, etc. In various particular implementations, separately housed components in the speaker 10 are configured to communicate using one or more conventional wireless transceivers.

In any case, the speaker 10 is configured to operate in at least two modes: i) as a stereo speaker on its own; and ii) as a stereo paired speaker connected with an additional speaker. In the first mode, each speaker 10 is capable of outputting stereo audio on its own, that is, each speaker 10 has a plurality of transducers 30 configured to act as a stand-alone stereo speaker system. In other words, the stereo audio that each of the speakers 10 is capable of outputting on its own is unmodified (or, full) stereo audio. In the second mode, the speaker 10 is paired with at least one additional speaker to form a stereo paired playback system.

In various implementations, for example, where the speaker 10 has two transducers 30, those transducers 30 are positioned such that their respective firing directions are misaligned. In particular example cases, the transducers 30 are positioned approximately 180 degrees apart from each other, such that the firing direction of a first one of the transducers 30 is opposite the firing direction of a second one of the transducers 30. In other example implementations, the transducers 30 can be separated by approximately 60 degrees to approximately 120 degrees. However, it is understood that in various implementations, the transducers 30 are aligned at any nonzero angle, such that they are misaligned.

In certain implementations, more than one transducer 30 in a given speaker 10 is connected to one power amplifier channel (e.g., a woofer and a passively-crossed-over tweeter). In cases where the speaker 10 includes a plurality of transducers 30, those transducers 30 can include a plurality of drivers arranged in a directional array. In these cases, the processing of channel input signals (such as left channel signals, right channel signals and center channel signals, as described herein) can be applied to multiple amplifiers and drivers to produce a desired audio directionality.

Figure 2:
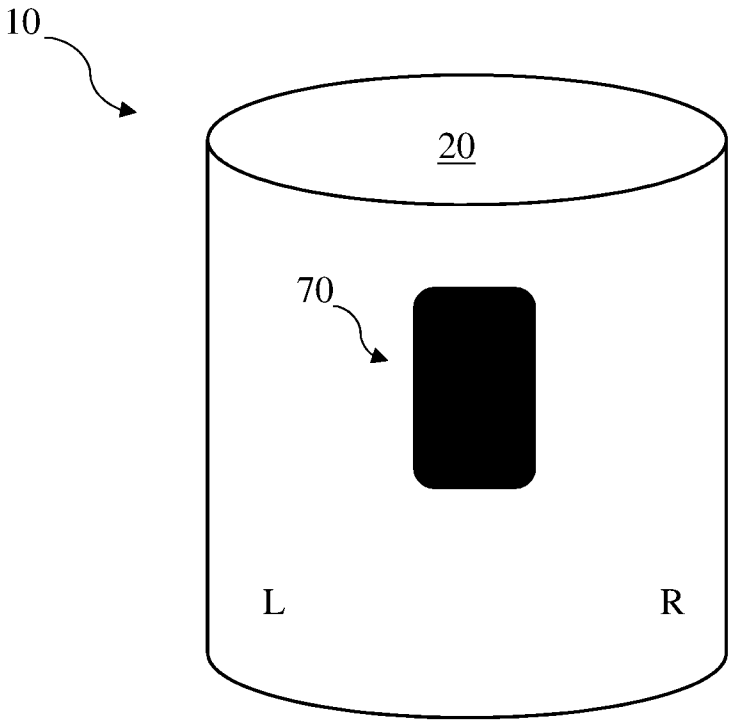
FIG. 2 is a perspective view of the loudspeaker of FIG. 1, illustrating channel assignments for audio output.

FIG. 2 illustrates example channel assignments for the speaker 10 shown in FIG. 1. As shown in this depiction, the speaker 10 is configured to output left and right channel audio, for example, from left and right channel input signals, respectively. Left and right channel assignments, depicted by L and R, are shown merely for illustrative purposes. That is, left and right channel assignments can be rearranged (e.g., where L is right and R is left) in various implementations. In certain implementations, the left and right channel assignments are designated by the output signal that is sent to each transducer 30 (FIG. 1). That is, the controller 60 receives an input signal from an audio source (e.g., audio gateway, internet radio station, local storage) that includes a left channel audio input signal and a right channel audio input signal. When the speaker 10 operates on its own, the controller 60 is configured to assign left (L) and right (R) channels by providing an audio output signal to each of the transducers 30 that includes right channel audio from the right channel audio input signal or left channel audio from the left channel audio input signal. That is, in the case of a speaker 10 with two transducers, the controller 60 processes the right channel audio input signal and the left channel audio input signal, and provides right channel audio (output) to a first one of the transducers 30 (e.g., the right (R) transducer) and left channel audio (output) to the other one of the transducers 30 (e.g., the left (L) transducer). FIG. 2 additionally illustrates an example interface 70 at the speaker 10, e.g., a digital display, touch screen or other conventional interface coupled with the controller 60 (FIG. 1) for displaying information and/or receiving user commands.

Figure 3:
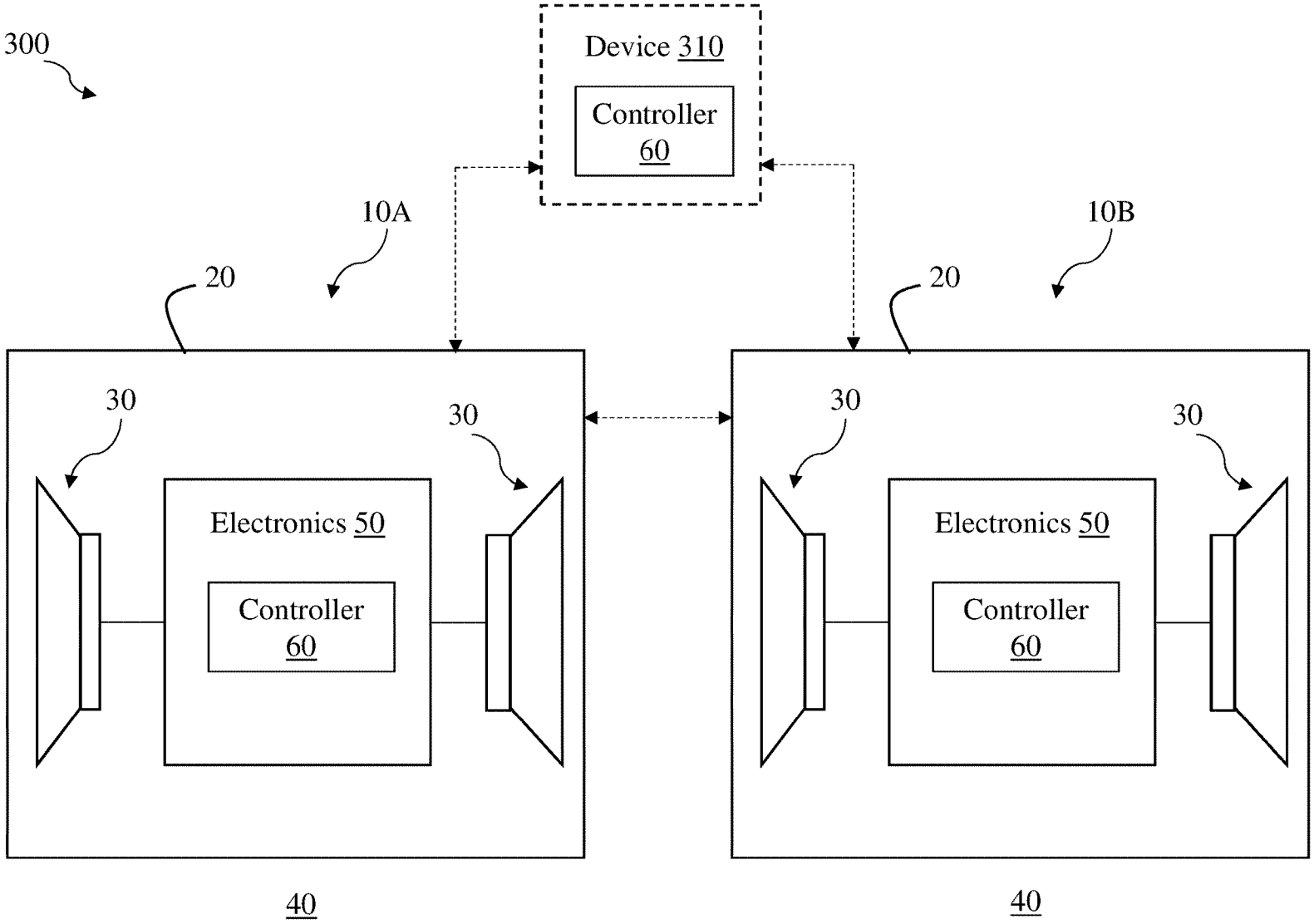
FIG. 3 is a schematic view of a speaker system including a stereo paired set of loudspeakers according to various implementations.

FIG. 3 illustrates a speaker system 300 including a set of speakers 10, which in this depiction, includes two paired speakers 10. Separate speakers are depicted in this example as speakers 10A, 10B, but it is understood that a paired set of speakers can include several speakers or more in various implementations. Speakers 10A, 10B are connected in a stereo pair, and are configured to act in concert to provide stereo audio output, just as each of them is capable of outputting on their own. Speakers 10A, 10B are paired using any conventional pairing approach.

In a particular example implementation, controllers 60 at distinct speakers 10A, 10B are configured to pair the speakers 10A, 10B by: a) initiating audio output at one or more of the transducers 30 at a first speaker (e.g., speaker 10A); b) detecting the audio output from the first speaker (e.g., speaker 10A) at a microphone array (e.g., in electronics 50) on a second speaker (e.g., speaker 10B); and c) determining a distance and relative orientation between the two speakers based on a travel time and detected directionality for the audio output from the first speaker 10A to the second speaker 10B. In various implementations, the controllers 60 in speakers 10A and 10B can communicate with one another to send data about audio output, e.g., controller 60 at speaker 10A sends timestamp data to controller 60 at speaker 10B indicating the time of the audio output from speaker 10A.

Controller 60 at speaker 10B is then configured to calculate the travel time for the audio output signal from the transducer(s) 30 at speaker 10A to the microphone(s) at speaker 10B. Additionally, for example where the speaker 10B includes a microphone array, the controller 60 at speaker 10B can use conventional beamforming techniques to detect the directionality of the audio output signal from the speaker 10A that is detected by the microphones at speaker 10B.

In some of these example implementations, the user can initiate the pairing process, e.g., via a software application or interface command at the speakers 10A, 10B. For example, a software application running at the device 310 and/or otherwise included in code at the controller 60 can allow entry into a pairing mode via a user interface command (e.g., button press, gesture-based command, etc.). In the example pairing mode, the application prompts the user to indicate which speaker (e.g., speaker 10A) should be designated as the "left" speaker, and in response to the user command, assigns output channels and configures speakers (e.g., left speaker 10A, and right speaker 10B) for audio output. Where more than one channel is configured (e.g., L, R, C, LS, RS, etc.), the application is configured to assign output channels according to the number of speakers in the paired group and their orientation. In other example implementations, the controller 60 at one or both speakers 10A, 10B is configured to initiate this acoustic signal-based pairing process based upon detecting the presence of another speaker within a communications range (e.g., in BLE range, or on the same local network such as a Wi-Fi network).

In various implementations, speakers 10A, 10B can be paired using a software application such as a stereo audio control application running at the controller 60 on one or both speakers 10A, 10B. In other cases, as described herein, the controller 60 is only located at one of the speakers 10A, 10B. In still further implementations, the controller 60 is located on a separate connected device 310 (e.g., a personal computing device or a smart device such as a smartphone or smart watch, or another wearable control device connected by any wireless or hard-wired means described herein) and is configured to send control signals to one or both speakers 10A, 10B. Example communications links between components such as the device 310 and speakers 10A, 10B are illustrated by dashed lines. In any case, these paired speakers 10A, 10B work together to provide the stereo output, for example, receiving signals from an audio source (e.g., audio gateway such as device 310, a network content source, etc.) at the same time and/or in the same format, and communicating over one or more shared links. That is, the speakers 10A, 10B are paired to form a singular speaker system 300.

Figure 4:
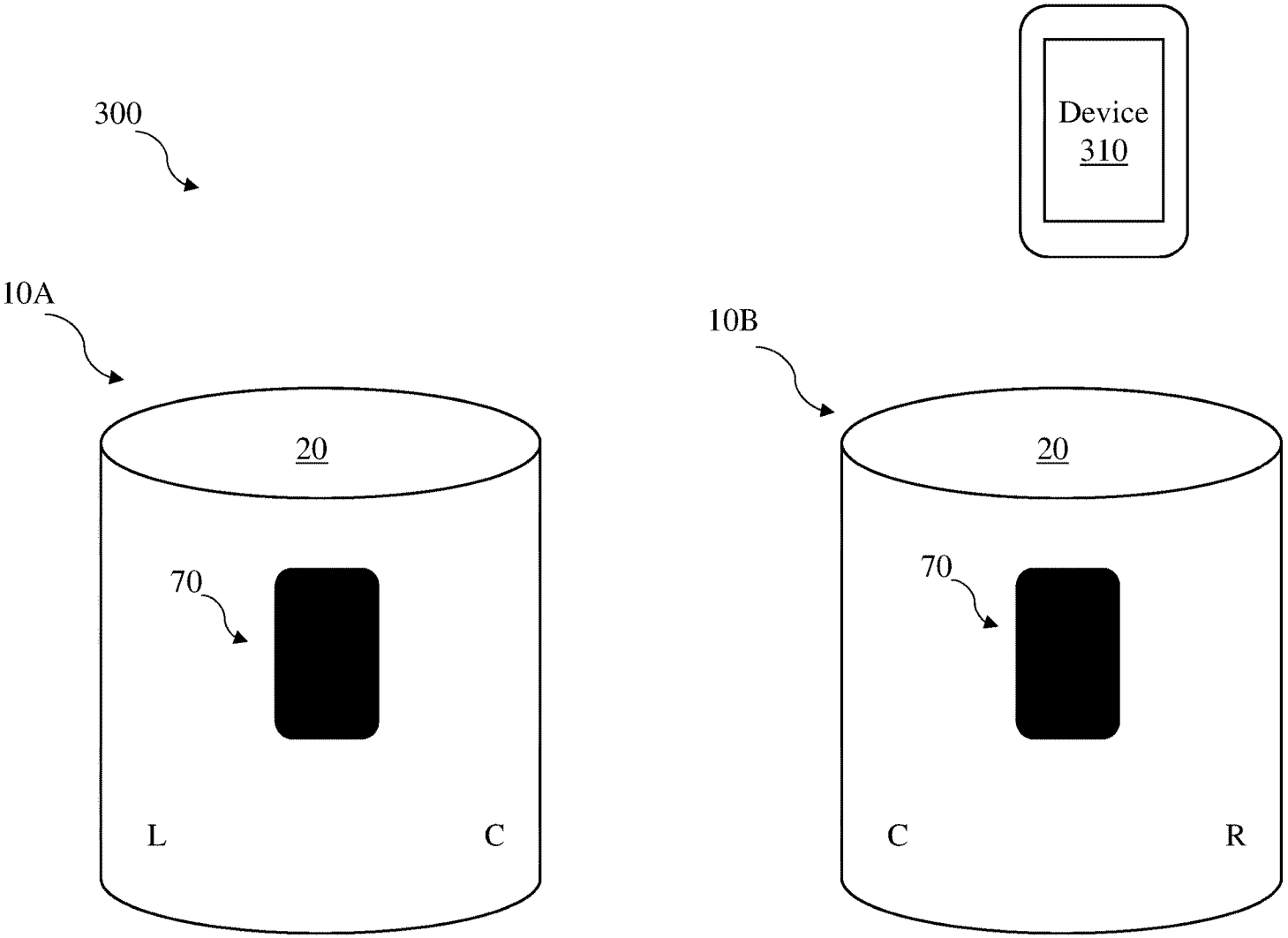
FIG. 4 shows is a perspective view of the speaker system of FIG. 3, illustrating channel assignments for audio output.

FIG. 4 depicts example channel assignments for the speaker system 300 according to various implementations, including left (L), right (R) and center (C) channel assignments in this example two-speaker configuration. It is understood that the channel assignments depicted in FIG. 4 are distinct from conventional channel assignments in a paired playback system, e.g., in a conventional two-speaker paired playback system. That is, conventionally, when speakers 10A and 10B are paired, the left speaker 10A assigns left channel audio (L) to all (e.g., both) of its transducers 30, and the right speaker 10B assigns right channel audio (R) to all (e.g., both) of its transducers 30. In the conventional configuration, the left speaker 10A outputs left channel audio, and the right speaker 10B outputs right channel audio. This configuration can be especially problematic with speakers that have multiple transducers, such as speakers 10A and 10B depicted in FIG. 4. In particular, the right transducer on speaker 10A (outputting left channel audio (L)) and the left transducer on speaker 10B (outputting right channel audio (R)) can have opposing firing patterns that cause the user to perceive little or no separation between the content output at these transducers.

Figure 5:
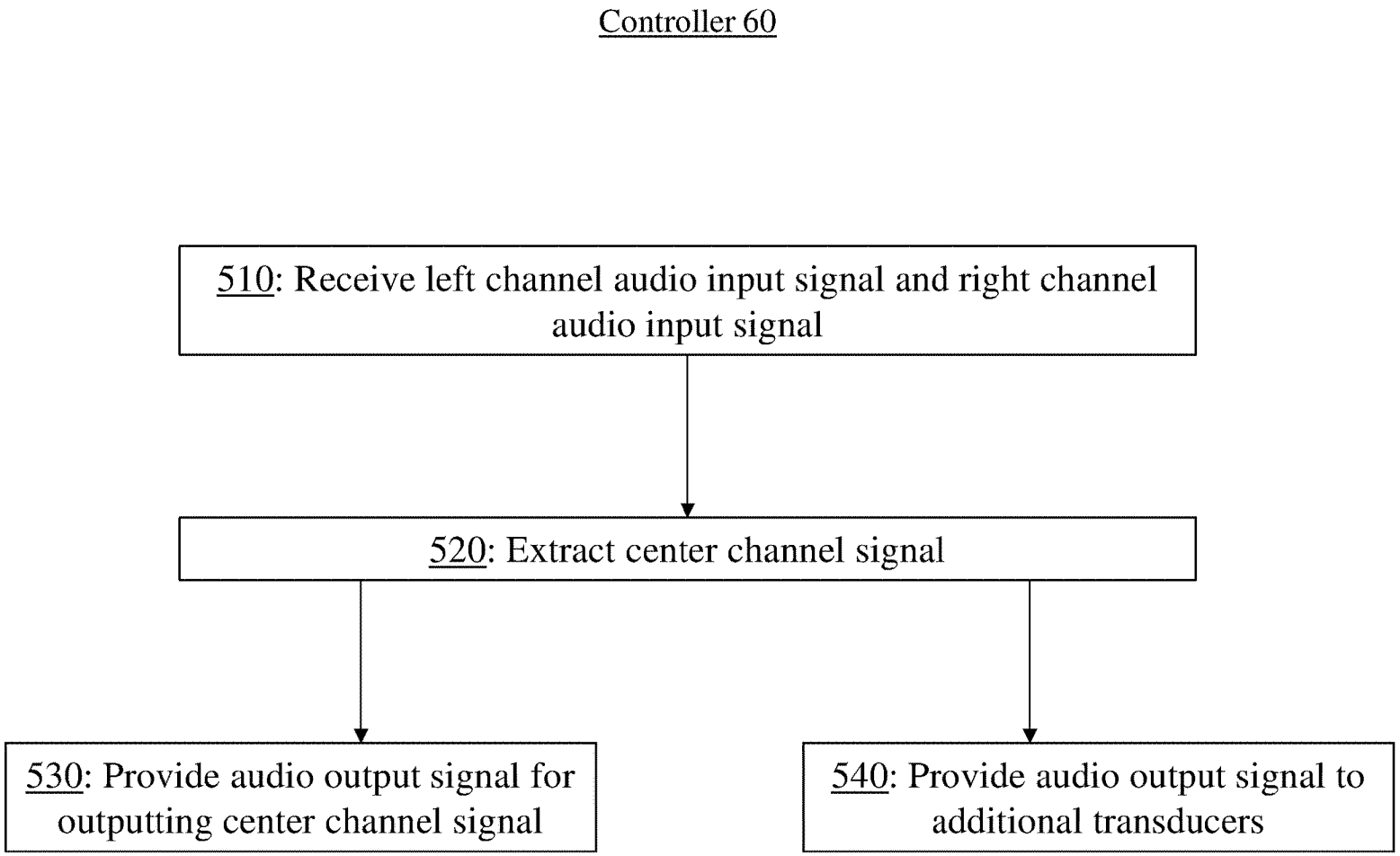
FIG. 5 is a flow diagram illustrating processes in a control method according to various implementations.

In contrast to the conventional systems and approaches, the controller(s) 60 in the speaker system 300 is configured to perform the following control processes, illustrated in the flow diagram in FIG. 5:

Process 510: Receive a left channel audio input signal and a right channel audio input signal. In certain cases, as described herein, left and right channel audio input signals can be received from one or more input devices, e.g., device 310, such as one or more audio gateway(s), network-connected playback devices, etc. Left and right channel audio input signals are received at the controller 60 as in the conventional paired speaker systems.

Process 520: Extract a center channel signal from the left channel audio input signal and the right channel audio input signal. In various implementations, the center channel signal includes correlated content from the left channel audio input signal and the right channel audio input signal. In various implementations, the center channel signal is extracted using left, right correlation information and amplitude information in the time domain or frequency domain. In some cases, the center channel signal is extracted using one signal band or multiple signal bands. As noted herein, in various implementations, the center channel signal of one of the speakers is different from the center channel signal of another one of the speakers.

Process 530: Provide an audio output signal to at least one of the transducers 30 in each speaker 10A, 10B for outputting the center channel signal. Outputting this center channel signal is illustrated in the channel assignment depiction of the system 300 in FIG. 4, where the center channel signal is illustrated by channel assignment (C). In certain cases, the center channel signal of one of the speakers 10 is different from the center channel signal of another one of the speakers 10 in the stereo pair. For example, the center channel signal provided to the right transducer 30 in speaker 10A is not identical to the center channel signal provided to the left transducer 30 in speaker 10B. More particularly, the center channel signal sent to one of the transducers 30 includes a greater percentage of the left or right channel audio signals relative to the center channel signal sent to another one of the transducers 30. For example, in some implementations, the center channel signal of one of the speakers 10 includes a greater percentage of the left channel audio input signal relative to the center channel signal of the other speaker(s) 10. In the example shown in speaker system 300 (FIGS. 3 and 4), in these implementations, the center channel signal sent to speaker 10A includes a greater percentage of the left channel audio input signal relative to the center channel signal sent to speaker 10B, which in turn includes a greater percentage of the right channel audio input signal.

In various implementations, the controller(s) 60 maintains synchronization between speakers 10 in the system 300 using clock signals. That is, the controller(s) 60 initiates playback of the center channel signals at the speakers 10 in a synchronized, or approximately synchronized manner (e.g., within a defined, short time window that is less than fractions of a second). Synchronized playback at the speakers 10 (e.g., speakers 10A and 10B) maintains a stable center image from the listener's perspective, preventing undesirable "wandering" in the output toward a particular speaker. This "wandering" effect is perceptual, and can result from time delay between two or more physical speakers. It is also referred to as the "precedence effect" or "the law of the first wavefront", and as noted herein, the controller 60 is configured to mitigate this effect in the systems described according to various implementations.

As shown in the signal assignment diagram in FIG. 4 and the flow diagram in FIG. 5 (process 540), the controller 60 is further configured to provide an audio output signal to one or more of the additional transducers 30 in speakers 10A, 10B. These additional transducers 30 are configured to output right channel audio based on the right channel audio input signal, and left channel audio based on the left channel audio input signal. In certain cases, one of the speakers 10 (e.g., speaker 10B) is configured to output right channel audio (shown as right channel audio assigned (R)) based upon the right channel audio input signal, and not to output left channel audio based upon the left channel audio input signal. In these cases, another one of the speakers 10 (e.g., speaker 10A) is configured to output left channel audio (shown as left channel audio assigned (L)) based upon the left channel audio input signal, and not to output right channel audio based upon the right channel audio input signal. In various implementations, the controller 60 provides the left channel audio to a transducer 30 at the left speaker 10A (e.g., left transducer 30) that is distinct from the transducer 30 at that speaker 10A outputting the center channel signal (e.g., right transducer 30), and provides the right channel audio to the right speaker 10B (e.g., right transducer 30) that is distinct from the transducer 30 at speaker 10B outputting the center channel signal (e.g., left transducer 30). In various implementations, the controller 60 modifies the left channel audio input signal to generate the left channel audio, and modifies the right channel audio input signal to generate the right channel audio. That is, the controller 60 modifies the left channel audio input signal by subtracting some amount of its content that is correlated with the right channel audio input signal, generating a modified left channel audio input signal (referred to as left channel audio). The controller 60 also modifies the right channel audio input signal by subtracting some amount of its content that is correlated with the left channel audio input signal, generating a modified right channel audio input signal (referred to as right channel audio).

In additional implementations, the controller(s) 60 is configured to synchronize (or approximately synchronize, within a defined short time window) the left channel audio output and the right channel audio output at each of the speakers 10. In some implementations the left channel audio input signal and the right channel audio input signal are in sync, meaning that the extracted center channel signal, if played back at speakers 10 in a synchronized manner, maintains balance across the L, R and C output at the speakers 10. However, in other cases, the left channel audio input signal and the right channel audio input signal are out of sync, and in these cases, the controller(s) 60 is configured to adjust at least one of the right channel audio or the left channel audio to synchronize output across the speakers 10, and/or modulate the center channel signals sent to the speakers 10.

In certain implementations, e.g., where a speaker 10 has more than two transducers 30, the controller 60 is configured to provide the audio output signal for outputting the center channel signal to more than one transducer 30. However, in various particular implementations, the controller 60 is configured to provide the audio output signal for outputting a center channel signal to only one of the plurality of transducers (e.g., one of the left or right transducer 30) at each speaker 10. That is, in various implementations, only one of the transducers 30 at each speaker 10 outputs a center channel signal (C).

In still further implementations, the controller 60 is configured to provide the audio output signal for outputting the center channel signal to at least one transducer 30 at each speaker 10. In some of these cases, the controller 60 is configured to provide the audio output signal for outputting the center channel signal to a plurality of transducers 30 at distinct speakers 10, e.g., in a multi-speaker system. In some cases, the transducers include at least one passively crossed-over transducer (e.g., a tweeter), or at least one additional powered transducer as part of a center axis.

In some additional implementations, when the speakers 10 are paired such as described with reference to the speaker system 300 (FIG. 3, FIG. 4) one of the loudspeakers 10 acts as a master loudspeaker and the additional loudspeaker acts as a worker loudspeaker. For example, in this depiction, speaker 10A acts as a master loudspeaker and speaker 10B acts as a worker loudspeaker. In these cases, the controller 60 at speaker 10A performs the control processes illustrated and describe with respect to FIG. 5, for example, by receiving both left and right channel audio input signals, extracting a center channel signal from those input signals, and providing an audio output to at least one of the transducers 30 at each speaker 10 for outputting the center channel signal. In these cases, while operating in the second mode (stereo paired mode), the controller 60 at speaker 10A controls the audio output at both speaker 10A and speaker 10B. According to various implementations, the controller 60 at the master speaker (e.g., speaker 10A) is configured to control at least one of the following audio output parameters for all of the speakers 10 in the playback system: a) distribution of the left channel audio input signal and the right channel audio input signal, e.g., between speakers 10A, 10B and other speakers; b) playback operations, e.g., play/pause/skip of playback at speakers 10A, 10B; c) clock synchronization between speakers 10A, 10B; d) volume changes, e.g., at each of the speakers 10A, 10B; e) loudspeaker pairing, e.g., between speakers 10A, 10B as well as additional speakers 10 in the system 300; f) image display, e.g., at a display or other interface 70 located on one or both speakers 10A, 10B or e) microphone availability, e.g., to detect ambient acoustic signals such as voice commands at the speakers 10A, 10B.

In still further implementations, the controller(s) 60 is configured to manage bass output across the speakers in the systems described herein. For example, the controller(s) 60 is configured to perform additional processes in managing bass output at speakers (e.g., 10A, 10B) in order to enhance energy produced by the systems (e.g., system 300). In a particular example, the controller(s) 60 is configured to: a) sum the left channel audio input signal and the right channel audio input signal; b) low-pass filter the sum of those signals; and c) distribute the filtered signals to all transducers 30 capable of reproducing signals in that range. The high-passed versions of the input signals are distributed to appropriate transducers at each speaker 10 and summed with the bass (e.g., "mono") component. This approach can enhance energy output in the system, e.g., system 300. In a conventional system, for a left-only signal, a controller will limit output to particular transducers that are not outputting the left channel audio. In contrast to these conventional systems, in certain cases, the controller 60 is configured to sum bass signals and distribute those signals to a plurality of transducers 30 in each speaker 10 to enhance output. That is, because bass energy conventionally requires the greatest amount of transducer resources to reproduce, distributing the bass signals across a plurality of transducers 30 at each speaker 10 enables greater bass output, and consequently, louder, high-quality playback for the listener.

Figure 6:
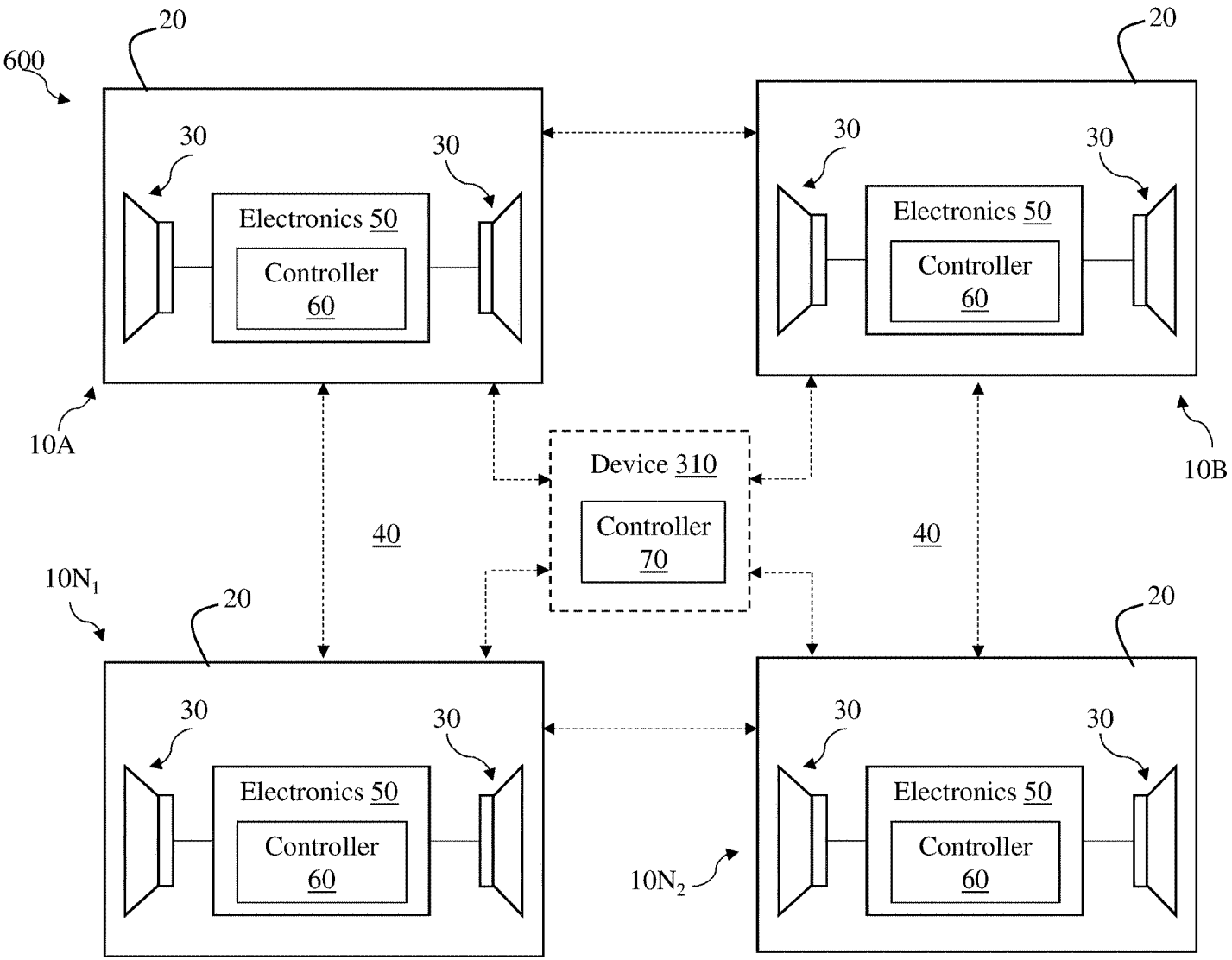
FIG. 6 is a schematic view of a speaker system according to various additional implementations.

In some implementations, for example as depicted in the speaker system 600 in FIG. 6, speakers 10A and 10B are connected with at least one additional speaker 10, illustrated as additional speakers $\mathbf{10}N_1$, $\mathbf{10}N_2$, etc. The additional speakers $\mathbf{10}N_1$, $\mathbf{10}N_2$ can include one or more transducers, and can be a similar model/type speaker as those shown and described with reference to the speaker system 300, or can be a distinct speaker with at least one transducer. In particular implementations, the additional speakers $\mathbf{10}N_1$, $\mathbf{10}N_2$ are paired with one or more of speakers 10A or 10B, and in some cases, these additional speakers $\mathbf{10}N_1$, $\mathbf{10}N_2$ act as worker speakers to master speaker 10A or 10B.

As noted herein, the speaker systems and control processes described herein can improve on conventional stereo paired speaker systems. These systems disclosed according to various implementations can enhance the user experience by providing clearer delineation between audio output as compared with conventional systems. Additionally, these the approaches described according to various implementations enable users to dynamically adjust system configurations without sacrificing the quality of audio output.

It is understood that the relative proportions, sizes and shapes of the speakers 10 and components and features thereof as shown in the FIGURES included herein can be merely illustrative of such physical attributes of these components. That is, these proportions, shapes and sizes can be modified according to various implementations to fit a variety of products. For example, while a substantially can-shaped (or tubular-shaped) loudspeaker may be shown according to particular implementations, it is understood that the loudspeaker(s) also take on other three-dimensional shapes in order to provide acoustic functions described herein.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. A speaker system comprising:

at least two distinct loudspeakers each capable of outputting stereo audio on its own, wherein each loudspeaker comprises: a plurality of transducers, and a controller coupled with the plurality of transducers, wherein the controller in each loudspeaker is configured to:

receive a left channel audio input signal and a right channel audio input signal;

extract a center channel signal from the left channel audio input signal and the right channel audio input signal;

assign output channels according to a number of distinct loudspeakers in the at least two loudspeakers;

provide an audio output signal to at least one of the plurality of transducers for outputting the center channel signal; and maintain synchronization between the distinct loudspeakers using clock signals.

2. The speaker system of claim 1, wherein the center channel signal comprises correlated content from the left channel audio input signal and the right channel audio input signal, and wherein the center channel signal is extracted using left, right correlation information and amplitude information in time domain or frequency domain.

3. The speaker system of claim 2, wherein the center channel signal of one of the at least two distinct loudspeakers is different from the center channel signal of another of the at least two distinct loudspeakers, and wherein the center channel signal of the one of the at least two distinct loudspeakers includes a greater percentage of the left channel audio input signal relative to the center channel signal of the other of the at least two distinct loudspeakers.

4. The speaker system of claim 1, wherein one of the at least two distinct loudspeakers is configured to output, via at least one of its plurality of transducers, right channel audio based on the right channel audio input signal, and wherein another of the at least two distinct loudspeakers is configured to output, via at least one of its plurality of transducers, left channel audio based on the left channel audio input signal, and wherein the left channel audio and the right channel audio are each modified relative to the left channel audio input signal and right channel audio input signal, respectively.

5. The speaker system of claim 1, wherein at least one of the plurality of transducers at each loudspeaker outputs the center channel signal.

6. The speaker system of claim 1, wherein the at least two distinct loudspeakers are paired to comprise a singular playback system.

7. The speaker system of claim 1, wherein the at least two distinct loudspeakers comprise two loudspeakers, and wherein the system further comprises an additional loudspeaker paired with the two loudspeakers, the additional loudspeaker having at least one transducer.

8. The speaker system of claim 1, wherein the plurality of transducers of each loudspeaker includes at least a first transducer and a second transducer, the first transducer configured to output audio in an opposite direction than the second transducer.

9. The speaker system of claim 1, wherein one of the at least two distinct loudspeakers is configured to control at least one of the following for all other loudspeakers of the at least two distinct loudspeakers: distribution of the left channel audio input signal and the right channel audio input signal; playback operations; clock synchronization; volume changes; loudspeaker pairing; image display or microphone availability.

10. The speaker system of claim 1, wherein the controllers at distinct loudspeakers are configured to pair the at least two distinct loudspeakers by:

initiating audio output at one of the plurality of transducers on a first one of the loudspeakers;

detecting the audio output at a microphone array on a second one of the loudspeakers; and determining a distance and relative orientation between the at least two loudspeakers based on a travel time for the audio output from the first one of the loudspeakers to the second one of the loudspeakers and a detected directionality of the audio output received at the second one of the loudspeakers.

11. A loudspeaker comprising:

a plurality of transducers; and a controller coupled with the plurality of transducers, wherein the loudspeaker is configured to both output stereo audio on its own in a first mode, and pair with an additional loudspeaker in a second mode, wherein in the second mode, the controller is configured to:

receive a left channel audio input signal and a right channel audio input signal;

extract a center channel signal from the left channel audio input signal and the right channel audio input signal; and provide an audio output signal to at least one of the plurality of transducers for outputting the center channel signal, wherein the center channel signal comprises correlated content from the left channel audio input signal and the right channel audio input signal, wherein at least one of the plurality of transducers outputs the center channel signal, wherein the center channel signal is extracted using left, right correlation information and amplitude information in time domain or frequency domain, wherein the center channel signal of one of the at least two distinct loudspeakers is different from the center channel signal of another of the at least two distinct loudspeakers, and wherein the center channel signal of the one of the at least two distinct loudspeakers includes a greater percentage of the left channel audio input signal relative to the center channel signal of the other of the at least two distinct loudspeakers.

12. The loudspeaker of claim 11, wherein one of the plurality of transducers outputs the center channel signal and another one of the plurality of transducers provides one of left channel audio based on the left channel audio input signal or right channel audio based on the right channel audio input signal, wherein the other one of the left channel audio or the right channel audio is provided at a transducer at the additional loudspeaker, and wherein the left channel audio and the right channel audio are each modified relative to the left channel audio input signal and right channel audio input signal, respectively.

13. The loudspeaker of claim 11, wherein in the second mode: the loudspeaker and the additional loudspeaker are paired to comprise a singular playback system, and the loudspeaker acts as a master loudspeaker and the additional loudspeaker acts as a worker loudspeaker.

14. The loudspeaker of claim 11, wherein the controller in each loudspeaker is configured to:

assign output channels according to a number of distinct loudspeakers in the at least two loudspeakers; and maintain synchronization between the distinct loudspeakers using clock signals, wherein the center channel signal comprises correlated content from the left channel audio input signal and the right channel audio input signal, wherein the center channel signal is extracted using left, right correlation information and amplitude information in time domain or frequency domain.

15. A method of controlling audio output from at least two distinct loudspeakers each having a plurality of transducers, the method comprising:

at each of the loudspeakers:

receive a left channel audio input signal and a right channel audio input signal;

extract a center channel signal from the left channel audio input signal and the right channel audio input signal;

assign output channels according to a number of distinct loudspeakers in the at least two loudspeakers;

provide an audio output signal to the plurality of transducers for outputting the center channel signal, and maintain synchronization between the distinct loudspeakers using clock signals, wherein the center channel signal comprises correlated content from the left channel audio input signal and the right channel audio input signal, wherein the center channel signal is extracted using left, right correlation information and amplitude information in time domain or frequency domain.

16. The method of claim 15, wherein a first one of the loudspeakers outputs left channel audio based upon the left channel audio input signal and not right channel audio based upon the right channel audio input signal, and a second one of the loudspeakers outputs the right channel audio and not the left channel audio, wherein the center channel signal comprises correlated content from the left channel audio input signal and the right channel audio input signal, and wherein at least one of the plurality of transducers at each loudspeaker outputs the center channel signal.

* * * * *